US006798821B2

(12) United States Patent
Lian et al.

(10) Patent No.: US 6,798,821 B2
(45) Date of Patent: Sep. 28, 2004

(54) METHOD AND APPARATUS FOR SOLIDIFICATION-CONTROLLABLE INDUCTION MELTING OF ALLOY WITH COLD COPPER CRUCIBLE

(75) Inventors: Shuang-Shii Lian, Taipei (TW); Chu Hsia Ching, Taipei (TW)

(73) Assignee: National Taiwan University, Taipei (TW)

( * ) Notice: Subject to any disclaimer, the term of this patent is extended or adjusted under 35 U.S.C. 154(b) by 0 days.

(21) Appl. No.: 10/408,225

(22) Filed: Apr. 8, 2003

(65) Prior Publication Data

US 2004/0105483 A1 Jun. 3, 2004

(30) Foreign Application Priority Data

Dec. 2, 2002 (TW) ..... 91134940 A

(51) Int. Cl.[7] ..... F27D 7/06; H05B 6/22
(52) U.S. Cl. ..... 373/140; 373/156
(58) Field of Search ..... 373/138, 140, 373/141, 151, 152, 153, 154, 155, 156; 75/10.11, 10.14; 219/630; 266/211; 164/258, 573

(56) References Cited

U.S. PATENT DOCUMENTS 3,014,255 A * 12/1961 Gerhard et al. ..... 75/10.14
3,775,091 A * 11/1973 Clites et al. ..... 373/155
4,609,402 A * 9/1986 McMasters ..... 75/10.11
4,738,713 A * 4/1988 Stickle et al. ..... 373/156
4,838,933 A * 6/1989 Paillere et al. ..... 373/157
5,563,904 A 10/1996 Colpo et al.
5,892,790 A 4/1999 Abiko et al.
5,991,328 A * 11/1999 Choudhury et al. ..... 373/156
6,144,690 A 11/2000 Kusamichi et al.
6,210,478 B1 4/2001 Bewlay et al.

FOREIGN PATENT DOCUMENTS

TW 415593 12/2000

* cited by examiner

*Primary Examiner*—Tu Ba Hoang
(74) *Attorney, Agent, or Firm*—Rabin & Berdo, P.C.

(57) ABSTRACT

A method for solidification-controllable induction melting of alloy with cold copper crucible employs the vacuum induction furnace with cold crucible to melt metals, particularly active metals, to obtain alloy ingots having directionally solidified structure at the same time. By using the cold crucible also as a solidification mold in the melting of metal materials, controlling working parameters of the induction furnace, and changing the copper crucible design, it is possible to control the solidified structure of the melted alloy and obtain high quality ingots having impurity-free and directionally arranged or fine-crystalline structure. The problem of low metal melting efficiency in the conventional vacuum induction furnace with cold crucible due to loss of a large amount of heat carried away by cooling water for cooling the crucible can therefore be overcome.

5 Claims, 3 Drawing Sheets

METHOD AND APPARATUS FOR SOLIDIFICATION-CONTROLLABLE INDUCTION MELTING OF ALLOY WITH COLD COPPER CRUCIBLE

FILED OF THE INVENTION

The present invention relates to a method and apparatus for making alloys, and more particularly to a method and apparatus for solidification-controllable induction melting of alloy with a cold copper crucible.

BACKGROUND OF THE INVENTION

Generally speaking, a cast alloy having a pore-free and solidification-controlled special microstructure is superior to a traditionally cast alloy ingot in its strength, toughness and surface property, and is therefore a necessary material in modern electronic, semiconductor, machinery, aviation and defense industries for making, for example, superalloy turbine blades. Such cast alloy may also be employed in the electronic industry for making, for example, target material, if it is possible to obtain solidification-controlled fine crystal grains. However, long-term research has found that there are more impurities in a crystal boundary, making the crystal boundary relatively weak and allowing quicker diffusion when it is subjected to force under high temperature. A crack often extends along a transverse crystal boundary that is perpendicular to the direction of an applied force. One way for the cast alloy to have an upgraded performance is to cause the crystal to grow in the direction of the applied force, so as to eliminate the transverse crystal boundary and impurities. This is an advantage provided by the so-called directional controlled solidification.

In the directional solidification of an alloy to obtain a directionally solidified structure for the alloy, it is important to select proper alloy properties and correct parameters for casting apparatus.

In conventional general apparatuses or methods for obtaining directionally solidified structure, such as the heat-generating agent process (EP process) taught by McLean M. et al ("Directionally solidified materials for high temperature service", The Metals Society, 1983), the power reduction process (RD process) taught by VerSnyder F. L. et al (Modern Casting, 52(6): 68~75, 1967), and the high-rate solidification process (HRS process) taught by Higginbotham G J S et al (Mater. Sci. Technol., 2:442~459, 1986), the resultant alloys tend to have a microstructure showing relatively large difference at different areas and having uneven components, as in the case of Taiwanese Patent No. 415593 disclosing a system for measuring unidirectional solidification heat transmission in metal molds. Moreover, the conventional apparatuses or methods for obtaining a directionally solidified structure are usually expensive and have low productivity and reproducibility.

The currently available methods for melting and directional-controlled solidification of metals and non-metals, such as silicon, titanium, zirconium, etc., for manufacturing active alloys mainly include vacuum arc melting, vacuum induction melting, electron beam melting, plasma melting, etc. Among these methods, the vacuum arc melting method requires very high quality electrodes and raw materials, and needs additional alloy melting and casting to prepare the electrodes, which frequently have many shrinkage holes and impurities to adversely affect the quality of finished products manufactured through vacuum arc refining. As for the electron beam melting and the plasma melting, they have the disadvantages of requiring high vacuum and failing to remove gas impurities, as well as having an increased cost for maintaining the melting apparatus. A conventional induction-melting furnace has high melting efficiency. However, the problem of contamination of melting material by the refractory material of the crucible exists even in the melting of active metals, such as titanium alloys, with the vacuum induction-melting furnace. Before 1950's, people always tried to use ceramic crucibles to melt active metals, such as aluminum, silicon, titanium, etc. However, serious chemical reaction tends to occur between the ceramic crucible and metal melt to contaminate the resultant alloy. Thus, it was almost impossible to obtain highly pure active metals. However, new technological developments and industrial demands in recent years have resulted in the use of cold copper crucible in place of the ceramic crucible to solve the contamination problem.

For example, U.S. Pat. Nos. 5,892,790, 5,563,904, 6,144,690, and 6,210,478 all disclose melting apparatus similar to the induction furnace and using cold crucibles having differently shaped slits. According to these earlier patents, eddy current is produced in the metal melt in the cold crucible through electromagnetic induction. Due to a resistance of the metal melt, Joule heat is generated to heat and melt the metal, which is further stirred and becomes suspended state under the effect of electromagnetic field. The vacuum induction melting process is actually a combination of the conventional induction melting techniques with vacuum techniques to simultaneously control two variables, namely, pressure and temperature. With the vacuum melting, a pressure difference in the crucible causes gases in the metals to diffuse to the liquid surface of molten metals and is therefore removed from the metals, enabling largely reduced gas amount in the resultant ingot. Meanwhile, impurity elements are separated from the melt due to heat convection and density difference to locate at the liquid surface of the molten metals, enabling a good purifying effect.

T. Nakajima et al. (U.S. Pat. No. 5,892,790) have conducted researches about the influences of local refining and cold crucible vacuum induction melting under ultra vacuum on the purity of Ti—Al alloy. The research result indicates that the content of oxygen in the melt can be reduced to 85 ppm under an ultra vacuum of 10−7 Pa when the cold crucible vacuum induction melting process is used to manufacture Ti—Al alloy. In addition, supplying of argon gas in the melting would reduce the vaporization of aluminum but increase the content of oxygen in the melt materials. This problem may be somewhat alleviated by repeatedly highly vacuumizing the crucible and then supplying argon gas into the crucible for several times. On the other hand, while remelting via local refining enables reduction of content of oxygen to 13 ppm, the productivity thereof is low and the vaporization of aluminum is high to result in difficulties in controlling the alloy ingredients and mass production.

Kenji Abiko and Seiichi Takaki (Vacuum, Vol. 53, 1999, pp. 93–100), use cold crucible vacuum induction melting process to melt iron under an ultra vacuum of 7.5×10−6 Pa. The result indicates the contents of carbon, nitrogen, oxygen, sulfur, and hydrogen all are lower than 10 ppm.

All the methods and apparatus disclosed in the above-mentioned patents and references require additional directional solidification control equipment and cooling water to obtain the directionally solidified cast structure. It is therefore desirable to develop a method and apparatus enabling direct solidification control after melting to form the directionally solidified structure for the melted metals, so as to eliminate drawbacks existed in the conventional melting processes and to reduce overall costs for melting alloys and controlling the solidification of ingot.

SUMMARY OF THE INVENTION

A primary object of the present invention is to provide a method and apparatus for solidification-controllable induction melting of alloy with cold copper crucible, so as to enable direct solidification control after melting to obtain directionally solidified structure for the melted metals at reduced overall costs for melting alloys and controlling the solidification of ingot.

The method for solidification-controllable induction melting of alloy with cold copper crucible according to the present invention includes the following steps:

a. Position an alloy material in a material zone of a cold copper crucible included in a vacuum induction furnace apparatus;

b. Vacuumize the material zone to a predetermined degree of vacuum, and supply an inert gas into the material zone to produce a predetermined pressure;

c. Repeat the step b for several times to rarefy unwanted gases in the material zone and to increase differential pressure of gases in the furnace apparatus;

d. Supply a current having a predetermined frequency during melting; and e. Stop supplying of the current after a predetermined period of time.

The apparatus for solidification-controllable induction melting of alloy with cold copper crucible according to the present invention includes a vacuum pump, a vacuum meter, a crushed material feeder unit, an oil-pressure unit, an induction generator, and a crucible assembly. The crucible assembly includes a crucible having an internal metal material zone, and an induction coil provided on an outer surface of the crucible. The induction coil is wound from a copper tube that is coated with a silicon thermal-resistant insulating fiber jacket. The induction coil is internally provided with a cooling water circulation passage to communicate at two ends with external water inlet and water outlet made of copper tubes.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
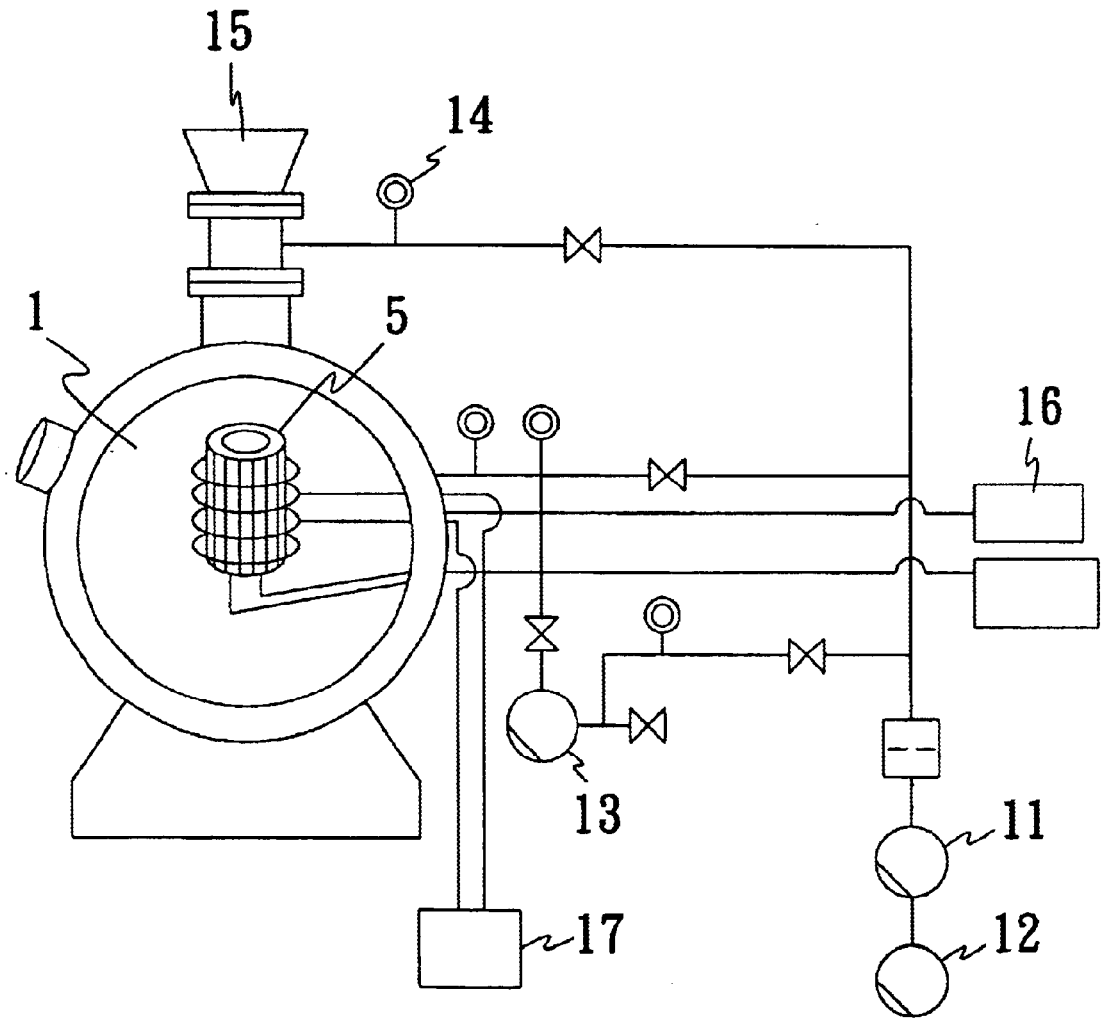
FIG. 1 is a perspective view of a whole apparatus for solidification-controllable induction melting of alloy with the cold cooper crucible of the present invention.

The present invention relates to a method and apparatus for solidification-controllable induction melting of alloy with cold copper crucible. The apparatus for implementing the method of the present invention is developed based on a Vacuum Induction Furnace with Cold Crucible (VIFCC) that is a technical means being currently developed in many advanced industrial countries for melting active and high-purity metals or alloys. This type of vacuum induction furnace has the advantages of providing high melting rate and electromagnetic stirring. Melting metals using VIFCC is a vacuum melting technique combining the theory of phenomena in using eddy current established by Oliver Heaviside (1884) and J. J. Thomson (1892) with the cold crucible to not only include the advantages provided by the induction furnace, but also reduce the contents of gases in the resultant ingot. There is a layer of crust of solidified metal melt formed between the cold copper crucible and the metal melt due to intensified water cooling. That is, the crucible has an inner layer that has the same ingredients as those of the metal melt and therefore avoids contamination of the metal melt by the crucible to enable melting of active and highly purified metals or alloys, which is otherwise impossible to achieve with the conventional vacuum induction furnace. Some variables, such as the melting efficiency of the vacuum induction cold copper crucible, the control of melt ingredients, the shape of copper crucible, and the frequency of the induction generator, have important influences on the alloy melting results. A major problem with the cold copper crucible is the cooling water used therewith carries away a large amount of heat to largely reduce the metal melting efficiency of the cold crucible. On the other hand, as having been mentioned above, the cast alloy having pore-free and solidification-controlled special microstructure is superior to the traditionally cast alloy ingot in its strength and heat resisting property, but requires additional directional solidification control equipment and cooling water to obtain the directionally solidified cast structure. The present invention contemplates controlling the solidified structure of alloys by using the cold crucible as a mold for solidification at the same time, controlling the working parameters of the induction furnace, and changing the copper crucible design, to eventually obtain high quality ingots having impurity-free and directionally arranged or fine-crystalline structure.

In a first experiment conducted in the method according to a preferred embodiment of the present invention, the alloy to be produced through melting is Al-2 wt. % Ti, and the vacuum induction furnace apparatus includes a vacuum pump, which may be a mechanical pump, roots pump, or diffusion pump, a vacuum meter, a crushed material feeder unit, an oil-pressure unit, an induction generator, which may be a model of 30 kW–200 kHz, and may have different output power through change of its overall conditions, and a cold copper crucible.

The vacuum induction furnace apparatus also includes an induction coil wound from a copper tube, which is coated with a silicon thermal-resistant insulating fiber jacket. To increase the melting power and to avoid unnecessary loss of magnetic lines, the coil is tightly attached to the outer wall surface of the cold copper crucible. The coil has a tube inner diameter of about 5 to 20 mm, 5 to 20 turns, a power up to 40%, and a frequency about 2 to 80 kHz, depending on the amount of alloy to be melted. The cold copper crucible employed in the present invention has an internal diameter about 40 to 60 mm, an external diameter about 50 to 80 mm, a height about 80 to 150 mm, axially extended slits in the number about 10 to 20 and having a width about 1 to 5 mm each, and a central round hole provided at a bottom of the crucible. The bottom round hole and the slits are provided to increase penetrated electromagnetic field to upgrade the melting power.

Figure 2:
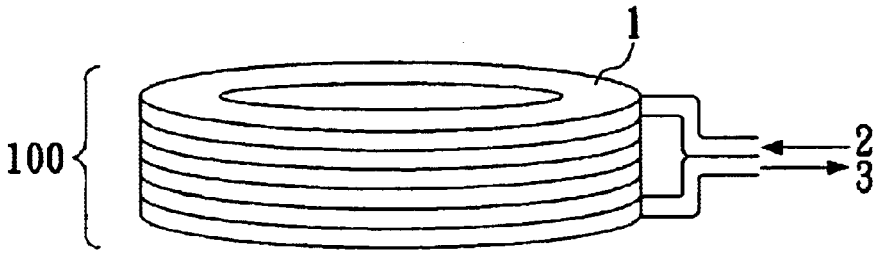
FIG. 2 is a schematic perspective view of an induction coil assembly included in an apparatus according to a preferred embodiment of the present invention.
Figure 3:
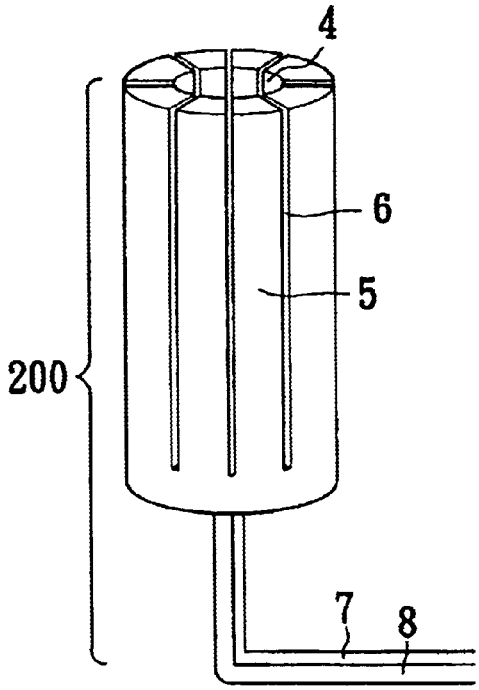
FIG. 3 is a schematic perspective view of a crucible assembly included in the apparatus according to a preferred embodiment of the present invention.
Figure 4:
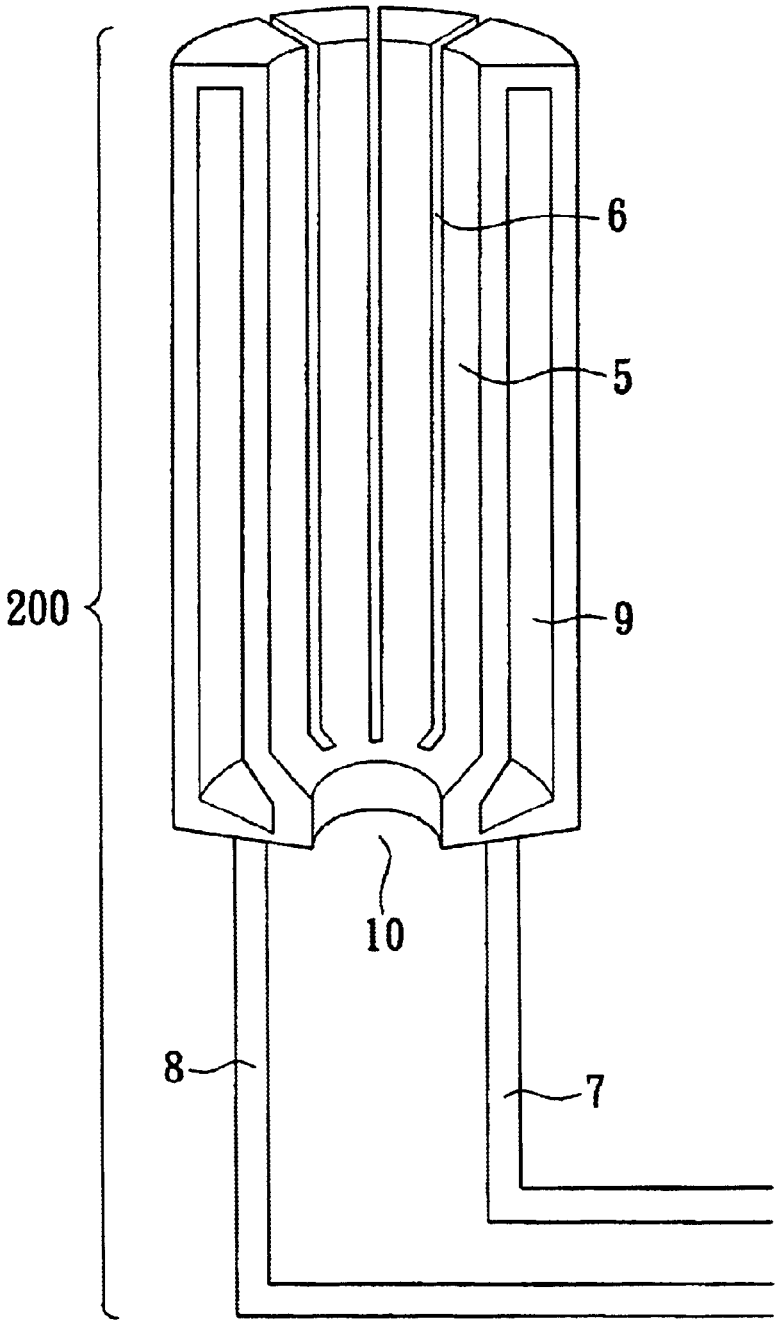
FIG. 4 is a partially sectioned perspective view of the crucible assembly of FIG. 3.

Please refer to FIG. 1, which is a perspective view of a whole apparatus for solidification-controllable induction melting of alloy with the cold copper crucible of the present invention. That is, the whole apparatus mainly comprises a mechanical pump 12, a roots pump 11, a diffusion pump 13, a vacuum meter 14, a crushed material feeder unit 15, an oil-pressure unfit 16, an induction generator 17 and other parts, such as a coil 1 and a copper crucible body 5, Please refer to FIGS. 2 and 3 that are perspective views of an induction coil assembly 100 and a crucible assembly 200, respectively, included in the apparatus according to a preferred embodiment of the present invention, and to FIG. 4 that is a partially sectioned perspective view of the crucible assembly 200 of FIG. 3. As shown, the induction coil assembly 100 includes a coil 1 wound from a copper tube, and a water inlet 2 and a water outlet 3 that also serve as places at where a voltage is applied to the coil. The crucible assembly 200 includes a metal material zone 4 for receiving alloy materials to be melted, a copper crucible body 5, a plurality of axially extended slits 6 provided on the copper crucible body 5, a water inlet 7, a water outlet 8, a water circulation passage 9 internally provided in the crucible body 5, and a central round hole 10 provided at a substantially conical bottom of the crucible body 5. The water inlet 7 and the water outlet 8 communicate with the water circulation passage 9 to allow supplied cooling water to flow in and out the water circulation passage 9 and thereby cool the alloy materials treated in the crucible body 5.

To melt the alloy materials with the method and the apparatus of the present invention, first a previously formulated alloy material is positioned into the metal material zone 4 of the crucible assembly 200, and then a vacuum of 10–1 to 10–4 torr is produced in the material zone 4. Thereafter, argon or helium gas is supplied into the material zone 4 to produce an internal pressure of 1–50 torr. The above steps of vacuumizing and supplying gas into the material zone 4 are repeated several times to rarefy gases, such as oxygen and nitrogen, in the furnace to increase a differential pressure of gas in the furnace and lower an evaporating rate of alloy ingredients. The furnace is set to a lower power output at the beginning of melting, and gradually adjusted to higher power output to fully melt the alloy material. The power output is then lowered and finally cut off after a predetermined period of time of about 15 to 45 minutes, and an alloy having directionally solidified structure may be obtained.

In a second experiment conducted in the method according to another preferred embodiment of the present invention, the alloy to be produced through melting is Al-5 wt % Sn, and the vacuum induction furnace apparatus with cold copper crucible is the same as that used in the first experiment. To produce the desired alloy, first a previously formulated alloy material is positioned into the metal material zone 4 of the crucible assembly 200, and then a vacuum of 10–1 to 10–4 torr is produced in the material zone 4. Thereafter, argon or helium gas is supplied into the material zone 4 to produce an internal pressure of 1–50 torr. The above steps of vacuumizing and supplying gas into the furnace are repeated several times to rarefy gases, such as oxygen and nitrogen, in the furnace to increase a differential pressure of gas in the furnace and lower an evaporating rate of alloy components. The furnace is set to a lower power output at the beginning of melting, and gradually adjusted to higher power output to fully melt the alloy material. Power supply to the furnace is quickly cut off after a predetermined period of time, and an alloy having a fine-crystalline structure may be obtained through control of power supply and cooling time.

The above-described two experiments have been successfully conducted and proven to exactly achieve the objects of the present invention.

The present invention has been described with a preferred embodiment thereof and it is understood that many changes and modifications in the described embodiment can be carried out without departing from the scope and the spirit of the invention as defined by the appended claims.

What is claimed is:

1. An apparatus for solidification-controllable induction melting of an alloy with a cold copper crucible, comprising:

a vacuum pump;

a vacuum meter;

a crushed material feeder unit;

an oil-pressure unit;

an induction generator; and a crucible assembly including a crucible and an induction coil provided on an outer surface of said crucible; said crucible defining an internal metal material zone for receiving an alloy material to be melted; said induction coil being wound from a copper tube that is coated with a silicon thermal-resistant insulating fiber jacket; and said induction coil being internally provided with a cooling water circulation passage to respectively communicate at two ends thereof with an externally connected water inlet and water outlet made of copper tubes.

2. The apparatus for solidification-controllable induction melting of alloy with cold copper crucible as claimed in claim 1, wherein said induction coil is tightly attached to the outer surface of said crucible to avoid unnecessary loss of magnetic lines.

3. The apparatus for solidification-controllable induction melting of alloy with cold copper crucible as claimed in claim 1, wherein said induction coil has a tube inner diameter within the range from 5 to 20 mm, and a number of turns within the range from 5 to 20.

4. The apparatus for solidification-controllable induction melting of alloy with cold copper crucible as claimed in claim 1, wherein said crucible is substantially in a cylindrical shape having an inner diameter within the range from 40 to 60 mm, an outer diameter within the range from 50 to 80 mm, and a height within the range from 80 to 150 mm, and being provided with a plurality of axially extended slits in a number within the range from 10 to 20, and each of said slits having a width within the range from 1 to 5 mm.

5. The apparatus for solidification-controllable induction melting of alloy with cold copper crucible as claimed in claim 1, wherein said crucible includes a substantially conical bottom, and is provided at said conical bottom with a central round hole having a diameter within the range from 10 to 20 mm.

* * * * *